United States Patent [19]

Pietsch et al.

[11] Patent Number: 5,054,442

[45] Date of Patent: Oct. 8, 1991

[54] BEARING BRIDGE CONSTRUCTION FOR THE CRANKSHAFT MOUNTING OF A COMBUSTION ENGINE

[75] Inventors: Albert Pietsch, Illingen; Georg Eiermann, Fellbach-Schmiden; Wolf Boll, Weinstadt, all of Fed. Rep. of Germany

[73] Assignee: Mercedes-Benz AG, Fed. Rep. of Germany

[21] Appl. No.: 553,621

[22] Filed: Jul. 18, 1990

[30] Foreign Application Priority Data

Jul. 20, 1989 [DE] Fed. Rep. of Germany ..... 3923986

[51] Int. Cl.[5] ..... F02F 7/00; F01M 11/02; F01M 1/02

[52] U.S. Cl. ..... 123/195 H; 123/198 E; 384/429

[58] Field of Search ..... 123/195 H, 198 E; 384/429, 432

[56] References Cited

U.S. PATENT DOCUMENTS

| | | | |
|---|---|---|---|
| 4,856,486 | 8/1989 | Mori et al. | 123/195 H |
| 4,876,998 | 10/1989 | Wunsche | 123/198 E |
| 4,911,117 | 3/1990 | Nishimura et al. | 123/195 H |
| 4,911,118 | 3/1990 | Kageyama et al. | 123/195 H |

FOREIGN PATENT DOCUMENTS

| | | | |
|---|---|---|---|
| 3824553 | 2/1989 | Fed. Rep. of Germany . | |
| 0127915 | 6/1986 | Japan | 384/432 |

*Primary Examiner*—David A. Okonsky

*Attorney, Agent, or Firm*—Evenson, Wands, Edwards, Lenahan & McKeown

[57] ABSTRACT

The invention relates to a bearing bridge connecting the main bearing seats of a reciprocating-piston combustion engine in the longitudinal direction of the crankshaft. To reduce the power loss caused by the oil flowing back into the crank case space striking the rotating drive parts, and the oil ageing rate, it is proposed to provide the bearing bridge between the main bearing seats with a shape which screens off the rotating drive parts of the combustion engine with respect to the crank case space.

9 Claims, 1 Drawing Sheet

BEARING BRIDGE CONSTRUCTION FOR THE CRANKSHAFT MOUNTING OF A COMBUSTION ENGINE

BACKGROUND AND SUMMARY OF THE INVENTION

The invention relates to a bearing bridge for connecting main bearing seats of the crankshaft mounting arrangement of a combustion engine.

A bearing bridge of this kind is already known from German Patent 3,824,553.

An object on which the invention is based is to provide a bearing bridge of the type described above with which, on the one hand, a reduction in the power loss caused by the oil flowing back into the crank case striking the rotating drive parts and, on the other hand, a reduction in the oil ageing rate is achievable.

The object is achieved according to the invention by providing an arrangement wherein the bearing bridge forms a screen between the main bearing seats for the rotating drive parts of the combustion engine with respect to a crank case space.

By virtue of the design according to the invention of the bearing bridge, a space separated off with respect to the crank case space is created in which the rotating components of the combustion engine (crank pins, crank webs, big end and the counterweights) move. The oil flowing back out of the cylinders and the cylinder head thus passes back undisturbed into the crank case space without coming into contact with the rotating drive parts at all. The power loss caused by the so-called "splashing" is thereby reduced to a minimum. The screening off of the rotating drive parts also prevents intensive mixing of this oil which is flowing back with the very hot combustion gases passing via the piston rings into the crank case. As a result, the oil temperature remains at a relatively low temperature level. At the same time, the oil contamination caused by these gases is reduced. The rate of oil ageing and also the formation of sludge are thus markedly reduced.

Particularly effective screening off is achieved if the bearing bridge is designed as a dish-shaped casing, the dish rims of which extend into the transitional zone to the cylinder block and if, at the same time, the oil return bores for guiding back the oil from the cylinder head open between the bearing-bridge casing and the crank case wall into the crank case space.

In certain preferred embodiments it is provided that an oil run-off rib extending parallel to the longitudinal direction of the crankshaft and outwardly overlapping the dish rims is provided, with clearance on both sides at the crank case end of the cylinder block. This embodiment of the bearing bridge has the advantage that the oil scraped off by the piston rings and flowing back on the inner walls of the cylinder can drip off into the oil sump in controlled fashion between the bearing bridge casing and the crank case wall, i.e. likewise does not come into contact with the rotating drive parts.

Other objects, advantages and novel features of the present invention will become apparent from the following detailed description of the invention when considered in conjunction with the accompanying drawings.

BRIEF DESCRIPTION OF THE DRAWINGS

FIG. 2 is a schematic sectional view of a second preferred embodiment of a bearing bridge constructed according to the invention and.

DETAILED DESCRIPTION OF THE DRAWINGS

Figure 1:
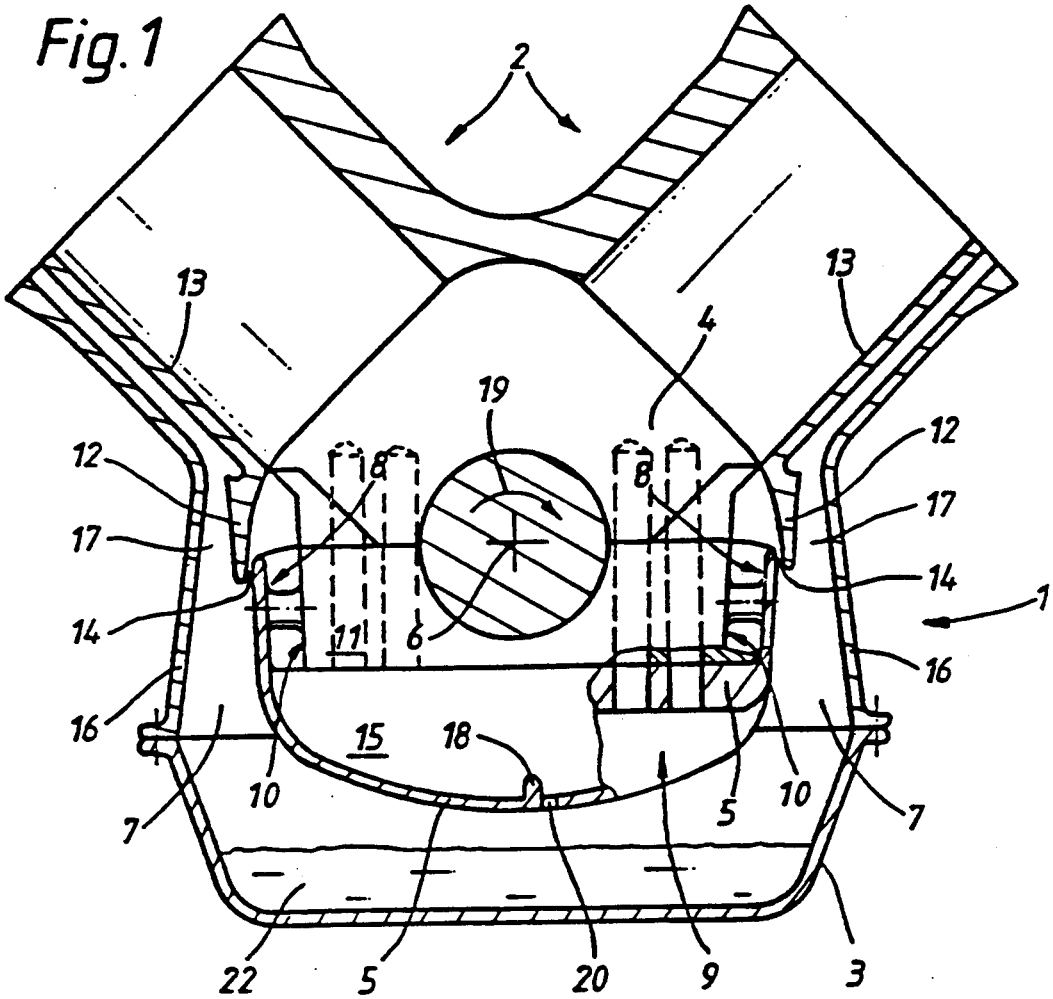
FIG. 1 is a schematic sectional view of a first preferred embodiment of a bearing bridge constructed according to the invention.

FIG. 1 shows the crank case 1 and the two cylinder block parts 2, adjoining the latter, of a V-configuration combustion engine. An oil pan 3 is screwed to the underside of the crankcase 1. The crankshaft, which, for reasons of clarity, is not shown, is mounted in the main bearing seats 4 firmly connected to the crank case 1. The individual main bearing seats 4 are connected to one another in the direction of the longitudinal axis 6 of the crankshaft (longitudinal direction of the crankshaft) by a bearing bridge 5 screwed to these seats. In the region between the main bearing seats 4, the bearing bridge 5 is designed in the form of a dish-shaped casing, which screens off the rotating drive parts, which are likewise not shown for reasons of clarity, with respect to the crank case space 7. The two dish rims 8 extend into the transitional zone to the cylinder blocks 2. At the level of the main bearing seats 4, the base of the bearing-bridge casing 5 is flattened and screwed to the main bearing seats 4 from the underside on both sides. This is shown clearly by the partial cutaway 9 which represents a cross-section at the level of the plane of the main bearing seat. The connecting screws have not been shown, for reasons of clarity. Otherwise, FIG. 1 shows a cross-section at the level of the region between two main bearing seats, in which region the bearing-bridge casing 5 is dish-shaped. For the purpose of additionally stiffening the crank case mounting, the dish rims 8 are screwed to the end walls 10, on the crank case side, of the bearing cap 11 of the main bearing seats 4.

An oil run-off rib 12 which extends parallel to the longitudinal direction of the crankshaft and at which the oil scraped off by the piston rings and running back on the inner walls 13 of the cylinders can drip off, is provided on each side at the crank case ends of the cylinder blocks 2. In this arrangement, the oil runoff ribs 12 are designed in such a way that they overlap the rims 8 of the dish-shaped bearing-bridge casing 5 at the outside with a small clearance. Dish rims 8 and run-off ribs 12 thus in each case form a small gap 14, via which the space 15 screened off by the bearing-bridge casing 5 is ventilated. Oil return bores 17, via which the oil flows back from the cylinder head, open between the crank case wall 16 and the bearing-bridge casing 5 into the crank case space 7. By virtue of the design according to the invention of the bearing bridge 5, neither the oil flowing back via the inner walls 13 of the cylinders and oil run-off ribs 12 nor the oil flowing back via the oil return bores 17 thus comes into contact with the rotating drive parts screened off by the bearing-bridge casing 5.

Arranged at the base of the bearing-bridge casing 5 is a shearing nose 18 which extends almost as far as the envelope curve of the rotating drive parts and at which the oil mist carried along by the rotating drive parts —which is always present in a crank case—is sheared off. The small quantities of oil which are still deposited on the base of the casing in this arrangement can flow off via the run-off bore 20 into the oil sump 22 situated in the oil pan 3, said bore being positioned upstream of the shearing nose 18 in relation to the direction of rotation of the rotating drive parts (arrow 19).

Figure 2:
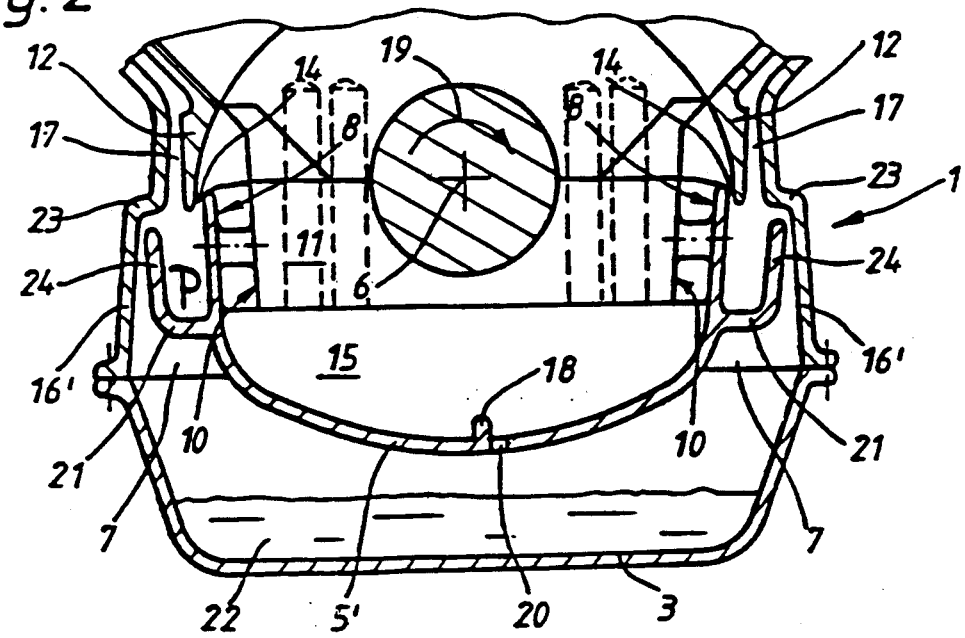

FIG. 2 shows another advantageous illustrative embodiment of a bearing bridge 5' according to the invention, the components which are identical to those of FIG. 1 having been denoted here by the same reference numerals. The two illustrative embodiments are the same except for the difference that one additional oil-catching pocket 21 respectively is integrally formed on each side in the area of the dish rims 8 at the outer side of the bearing bridge casing 5' illustrated in FIG. 2. These oil-catching pockets 21 catch the oil flowing back by way of the oil return bores 17 from the cylinder head as well as the oil wiped off the piston rings and flowing back at the cylinder walls 13. The oil collected in these catching pockets 2 is finally taken in again by an oil pump P which may, for example, be integrated in the bearing bridge casing 5 itself and returned to the oil circulating system. In order to be able to catch an amount of oil that is as large as possible, the crankcase wall 16', in the areas in which the oil return bores 17 lead into the crankcase space, is provided with a shoulder 23 which covers the edges 24 of the oil catching pockets 21.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A crankshaft mounting arrangement for a reciprocating-piston combustion engine including a cylinder block, comprising a bearing bridge for connecting main bearing seats to one another in a longitudinal direction of a crankshaft, wherein the bearing bridge forms a screen between the main bearing seats for the rotating drive parts of the combustion engine with respect to a crank case space, wherein the bearing bridge is designed as a dish-shaped casing, the casing having dish rims of which extend into a transitional zone to the cylinder block.

2. Crankshaft mounting arrangement according to claim 1, wherein oil return bores are arranged in the cylinder wall and open between the bearing-bridge casing and the crank case wall into the crank case space.

3. Crankshaft mounting arrangement according to claim 1, wherein a space screened off by the bearing-bridge casing is ventilated towards the crank case space.

4. Crankshaft mounting arrangement according to claim 1, wherein breathing of the screened-off space takes place in each case via a gap provided at the level of a transitional zone to the cylinder block.

5. Crankshaft mounting arrangement according to claim 1, wherein the bearing-bridge casing is produced separately from the main bearing seats and is connected to the latter by bolts.

6. Crankshaft mounting arrangement according to claim 2, wherein an oil-catching pocket is in each case integrally formed at the outer side of the bearing-bridge casing, below the oil return bores.

7. Crankshaft mounting arrangement for a reciprocating-piston combustion engine including a cylinder block bridge for connecting main bearing seats to one another in a longitudinal direction of a crankshaft, wherein the bearing bridge forms a screen between the main bearing seats for the rotating drive parts of the combustion engine with respect to a crank case space, wherein said cylinder block includes an oil run-off rib extending parallel to the longitudinal direction of the crankshaft and outwardly overlapping dish rims is provided with clearance from a cylinder block lower wall portion on both sides of said bearing-bridge.

8. Crankshaft mounting arrangement for a reciprocating-piston combustion engine including a cylinder block, comprising a bearing bridge for connecting main bearing seats to one another in a longitudinal direction of a crankshaft, wherein the bearing bridge forms a screen between the main bearing seats for the rotating drive parts of the combustion engine with respect to a crank case space, wherein the bearing bridge is designed as a dish-shaped casing, the casing having dish rims of which extend into a transitional zone to the cylinder block, wherein oil return bores are arranged in the cylinder wall and open between the bearing-bridge casing and the crank case wall into the crank case space, wherein an oil-catching pocket is in each case integrally formed at the outer side of the bearing-bridge casing, below the oil return bores, and wherein an oil pump, the suction side of which is connected to the oil-catching pockets, is integrated into the bearing-bridge casing.

9. Crankshaft mounting arrangement for a reciprocating-piston combustion engine including a cylinder block, comprising a bearing bridge for connecting main bearing seats to one another in a longitudinal direction of a crankshaft, wherein the bearing bridge forms a screen between the main bearing seats for the rotating drive parts of the combustion engine with respect to a crank case space, wherein, the bearing-bridge casing is provided in its base region with a shearing nose projecting into the screened-off space almost as far as an envelope curve of the rotating drive parts, at least one run-off bore being positioned upstream of the shearing nose in relation to the direction of rotation of the rotating drive parts.

* * * * *